United States Patent [19]

Svoboda et al.

[11] Patent Number: 4,848,228

[45] Date of Patent: Jul. 18, 1989

[54] DAMPING DEVICE WITH BIASED TRANSFER ROLLER ADJUSTMENT

[75] Inventors: Antonin Svoboda, Adamov; Borivoj Hoder, Letovice; Josef Jurny, Blansko, all of Czechoslovakia

[73] Assignee: ZVS Adamovske strojirny, Adamov, Czechoslovakia

[21] Appl. No.: 137,121

[22] Filed: Dec. 22, 1987

[30] Foreign Application Priority Data

Dec. 22, 1986 [CS] Czechoslovakia ..... PV9667-86

[51] Int. Cl.[4] ..... B41L 23/00

[52] U.S. Cl. ..... 101/147; 101/148

[58] Field of Search ..... 101/147–148, 101/348–352

[56] References Cited

U.S. PATENT DOCUMENTS

| | | | |
|---|---|---|---|
| 2,259,174 | 10/1941 | Neal et al. | 101/147 |
| 2,320,523 | 6/1943 | Jirousek | 101/147 |
| 2,570,242 | 10/1951 | James | 101/147 |
| 2,913,979 | 11/1959 | Hoopes | 101/147 |
| 3,343,484 | 9/1967 | Dahlgren | 101/148 |
| 3,411,442 | 11/1968 | Muhlich | 101/148 |
| 3,656,677 | 4/1972 | Stepanek et al. | 101/148 |
| 3,937,141 | 2/1977 | Dahlgren | 101/147 |
| 4,130,057 | 12/1978 | List et al. | 101/148 |

*Primary Examiner*—Eugene H. Eickholt

*Attorney, Agent, or Firm*—Klein & Vibber

[57] ABSTRACT

A dampening device for the continuous dampening of printing forms, particularly in offset printing machines has a supporting pin and a supporting sleeve, which are mounted in side walls of the printing machine. Holders are rotatably mounted on the pin and sleeve, and a transfer roller is removably mounted on the holders. The transfer roller, when mounted, is in permanent contact on one hand with a bathing cylinder, and on the other hand with a spreader roller. The holders are rotatable about the axis of the bathing cylinder.

12 Claims, 2 Drawing Sheets

DAMPING DEVICE WITH BIASED TRANSFER ROLLER ADJUSTMENT

FIELD OF THE INVENTION

The present invention relates to a damping device for continuous plate dampening, particularly in offset printing machines.

BACKGROUND OF THE INVENTION

In known damping devices in printing machines, the dampening of the printing form is performed by dosing the dampening solution by a swingable damping roller.

The transfer roller is alternatingly in contact with the bathing cylinder, from which the dampening solution is received, and the distributing roller, to which the dampening solution is transferred. The quantity of the transferred solution is controlled by changing the time of contact of the transfer roller with the bathing cylinder.

The disadvantage of the device is that the dosing is performed by strokes, this causing a fluctuation of the quantity of the solution fed to the printing form, whereby the quality of the printing is unfavorably affected. A further disadvantage of the device lies in the different circumferential speeds of the bating roller and the distributing roller, this being the reason why the transfer roller must alternate its circumferential speed, upon contact with said rollers. Thereby, a mutual slippage and chafing of the surface on the textile cover of the transfer roller is caused. This chafing of the surface reduces the capability of receiving and transferring the dampening solution. A further disadvantage of this device is that it is not suitable for dampening by alcohol.

There are other known dampening devices, in which the dampening solution is transferred to the printing plate in a contactless manner by brush rollers, resilient wires, or nozzles. The quantity of the transferred dampening solution is controlled by changing the springing of the hairs on the brush rollers, or possibly by changing the size of the slit, through which the solution is projected to the dampening rollers, by screening sheets.

The disadvantage of these known devices is that the hairs of the brush rollers are frequently broken, the wires released, or the nozzles clogged. All these failures negatively influence the uniformity of dampening, and thus, also the quality of printing.

SUMMARY OF THE INVENTION

The purpose of the present invention is to provide a damping device, which would make possible a uniform and continuous feeding of the dampening solution to the printing plate. It is among the objects of the invention that the mounting of the removable rollers, particularly the transfer roller, should be made in such manner that, upon their removal (for the purpose of cleaning) and their remounting into the dampening device, it should not be necessary to perform any re-adjustment of the rollers. The fastening of the transfer roller and the adjustment of its position should be performed in such manner, such that the mutual contact of the transfer roller with the distributing roller remains unchanged upon adjustment of the contact of the transfer roller and the bathing cylinder.

The above mentioned disadvantages of the known devices are mitigated by a device according to the present invention, where slightly turnable holders are mounted on the first supporting pin and the supporting sleeve, concentrically with the axis of the bathing cylinder; and in said holders, a transfer roller is dismountably mounted, which is in permanent contact with the bathing cylinder, said holders being provided on one hand with bolts, in which are mounted adjusting screws bearing against antifriction bearings, and on the other hand with spring loaded pawls. Inside the hollows of the holders, spring loaded sliding sleeves are mounted, bearing against the antifriction bearings, which are located on the end pins of the transfer roller. In the holders, tie rods are fastened, which are provided with compression springs, bearing against the support fastened in the side walls, said tie rods being mounted with their threaded end in the supports and provided with adjusting nuts, bearing against the supports.

An advantage of this device is the possibility of continuous regulation of the dampening solution dosing from one point, usually from the delivery, preferably in multicolor printing machines. A further advantage of the device is two mutually independent regulations of the transfer roller, one on the side of the bathing cylinder and another on the side of the distributing roller. A further advantage lies in the mounting of the transfer roller securing, upon its dismounting from the holders and its remounting, its originally adjusted position, thus making unnecessary any readjustment of the transfer roller position. A still further advantage is the possibility of using the device also for dampening by an alcohol solution.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENT

Figure 1:
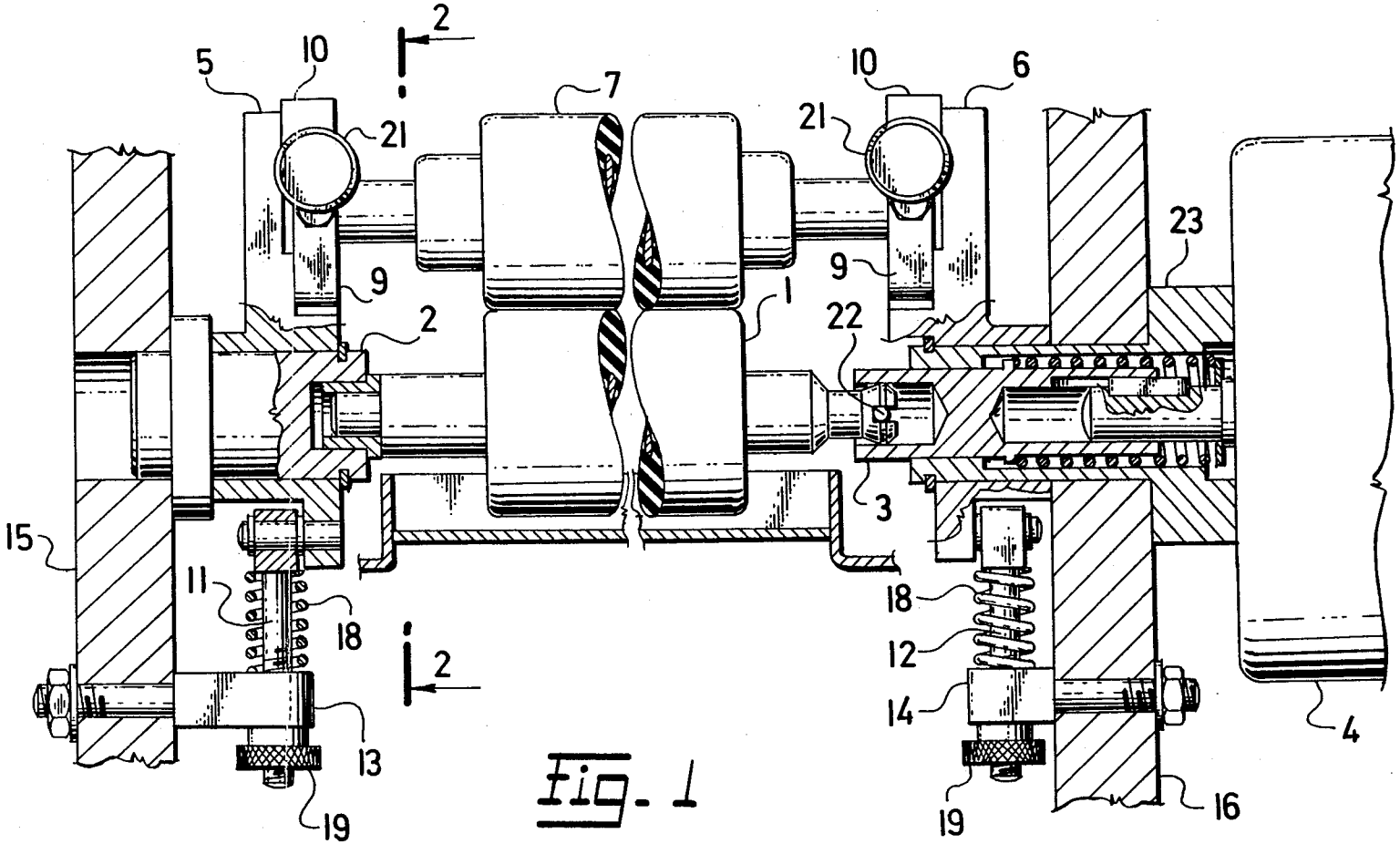
FIG. 1 is a front view of the dampening device in partial longitudinal section.

Referring first to FIG. 1, the inventive damping device comprises a bathing cylinder 1, which is mounted with its end pins in supporting pins 2, 3. The first supporting pin 2 is fixed in the left side wall 15, and the second supporting pin 3 is rotatably mounted in supporting sleeve 23, which is fixed in the right side wall 16. The second supporting pin 3 is connected, through intermediary of driving pin 22, to the end pin of bathing cylinder 1 and, by intermediary of a clutch, to the shaft of electric motor 4.

A holder 5 is rotatably mounted on the first supporting pin 2. Holder 6 is rotatably mounted on the supporting sleeve 23. Transfer roller 7 is rotatably mounted by means of antifriction bearing 8 (FIG. 2) in the holders 5, 6, and the transfer roller 7 is in contact with the bathing cylinder 1.

In the left side wall 15, a support 13 is fastened, in which one end of tie rod 11 is mounted, which is provided with compression spring 18 and adjusting nut 19. Tie rod 11 is connected by intermediary of a pin to holder 5. In the right side wall 16, a support 14 is fastened, in which one end of tie rod 12 is mounted, which is provided with compression spring 18 and adjusting nut 19. Tie rod 11 is connected by intermediary of a pin to holder 5 and tie rod 12 is connected by intermediary of a pin to holder 6.

Figure 2:
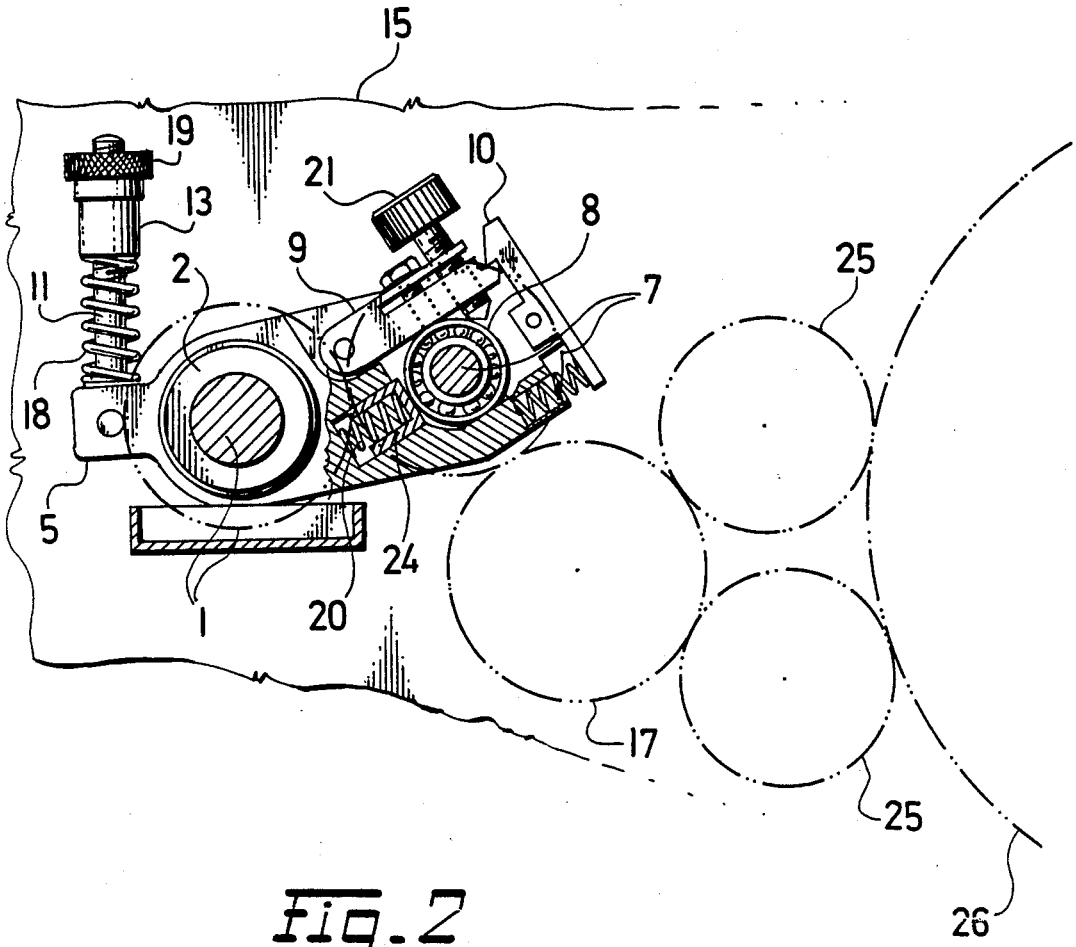
FIG. 2 is a mounting of the bathing cylinder in a section passing through plane A—A of FIG. 1.

Referring now to FIG. 2, holders 5, 6 are provided with bolts 9 and spring loaded pawls 10, provided with claws, engaging the recesses of bolts 9. In the bolts 9, adjusting screws 21 are screwed, bearing against the antifriction bearing 8, in which the end pins of the transfer roller 7 are mounted. In holders 5, 6 are provided hollows, inside which are mounted spring 20 and sliding sleeves 24. The sliding sleeves 24 are pressed by spring 20 against the antifriction bearings 8.

The holders 5, 6, together with the transfer roller 7, turn slightly about the axis of bathing cylinder 1. The transfer roller 7 remains in permanent contact with the bathing cylinder 1 and a spreader roller 17. The spreader roller 17 is in contact with two dampening rollers 25, which apply the dampening liquid on to the printing forms, which is mounted on the offset roller 26.

Referring again to FIG. 1, the second supporting pin 3 is engageably mounted in supporting sleeve 23, inside which a compression spring is mounted, which bears wit one end against a step of supporting pin 3, and with the other end against a supporting washer mounted on the shaft of electric motor 4.

The device according to the present invention operates as follows:

The transfer roller 7 continuously transfers the dampening solution from the bathing cylinder 1 to the spreader roller 17. The spreader roller 17 transfers the dampening liquid to two dampening rollers 25, which transfer the liquid continuously and uninterruptedly to the printing offset mounted on the form roller 26. The dosing of the dampening liquid is regulated by a stepless changing of the rotation of bathing cylinder 1, which is driven by electric motor 4 and a speed controller.

The transfer roller 7 is removably mounted in the holders 5, 6 in such manner, that upon removal pawls 10 and bolts 9 are released. The contact pressure of transfer roller 7 towards the bathing cylinder 1 is adjusted by turning the adjusting screws 21. The contact pressure of transfer roller 7 towards the spreader roller 17 is adjusted by turning the adjusting nuts 19 and the action of compression springs 18. During adjustment of the contact pressure between transfer roller 7 and bathing cylinder 1, the pressure adjusted between transfer roller 7 and spreader roller 17 is not affected. By adjusting screw 21, the transfer roller 7 is pressed against bathing cylinder 1, while by spring 20 and sliding sleeve 24, transfer roller 7 is pressed away from bathing cylinder 1. By mutual interaction of adjusting screw 21, spring 20 and sliding sleeve 24, transfer roller 7 is adjusted into the required operative position relative to bathing cylinder 1.

Although the invention is described and illustrated with reference to a single embodiment thereof, it is to be expressly understood that it is in no way limited to the disclosure of such preferred embodiment but is capable of numerous modifications within the scope of the appended claims.

We claim:

1. A dampening device for the continuous dampening of printing forms in offset printing machines, comprising a bathing cylinder, a transfer roller, a spreader roller and a plurality of dampening rollers, said cylinders residing between left and right side walls, the bathing cylinder being provided with an end pin at each of its ends;

said side walls each being provided with a supporting pin, said bathing cylinder being mounted by its end pins in said supporting pins;

one of said supporting pins being rotatably mounted in a supporting sleeve and provided with a driving pin;

said side walls each being provided with a holder, rotatably mounted concentric to said supporting pin;

said transfer roller being removably rotatably mounted on said holders, and being in contact with said bathing roller;

said transfer roller being mounted on each of said holders by an antifriction bearing; and each of said holders being provided with a spring loaded pawl and a bolt carring an adjusting screw, said adjusting screw bearing against said antifriction bearing and said pawl engaging said bolt.

2. A dampening device as claimed in claim 1, wherein each of said holders being provided with a hollow portion; and each of said holder carrying a spring loaded sliding sleeve within said hollow portion;

said sleeve bearing against said antifriction bearing.

3. A dampening device as claimed in claim 1, further comprising each of said holders being provided with a tie rod carrying a compression spring and having a threaded end; and each of said side walls being provided with a tie rod support;

said tie rod being fastened to said tie rod support by an adjusting nut on the threaded end of said tie rod, said compression spring bearing against said tie rod support.

4. A dampening device as claimed in claim 2, further comprising each of said holders being provided with a tie rod carrying a compression spring and having a threaded end; and each of said side walls being provided with a tie rod support;

said tie rod being fastened to said tie rod support by an adjusting nut on the threaded end of said tie rod, said compression spring bearing against said tie rod support.

5. A dampening device for the continuous dampening of printing forms in a printing machine by providing a supply of dampening solution from a bathing roller to a transfer roller, said device comprising a pair of transfer roller holders upon which holders said transfer roller is detachably mounted and adjustably positioned relative to said bathing roller;

said transfer roller being mounted on said holders by means of an antifriction bearing;

said transfer roller holders being provided with a retaining member and a biasing member between which members said transfer roller is mounted;

said transfer roller holders being further provided with means for adjusting a holding position of said retaining member to allow adjustment of the position of said transfer roller relative to said bathing roller;

each of said holders being provided with a hollow portion;

said biasing member comprising a spring loaded sliding sleeve within said hollow portion of said holder, said sleeve bearing against said antifriction bearing.

6. A damping device as claimed in claim 5 further comprising said transfer roller holders being pivotally mounted on an axis coincident with a longitudinal axis of said bathing cylinder.

7. A damping device as claimed in claim 5 further comprising said retaining means comprising a pawl and a bolt.

8. A damping device as claimed in claim 5 further comprising said retaining means comprising a pawl and a bolt and said adjusting means comprising a screw bearing against said antifriction bearing.

9. A damping device for the continuous dampening of printing forms in a printing machine by providing a supply of dampening solution from a bathing roller to a transfer roller, said device comprising a pair of transfer roller holders upon which holders said transfer roller is detachably mounted and adjustably positioned relative to said bathing roller;

said transfer roller holders being provided with a retaining means and a biasing member between which said transfer roller is mounted;

said transfer roller holders being further provided with means for adjusting a holding position of said retaining member to allow adjusting of the position of said transfer roller relative to said bathing roller;

said retaining means comprising a pawl and a bolt.

10. A damping device as claimed in claim 9 further comprising said transfer roller holders being pivotally mounted on an axis coincident with a longitudinal axis of said bathing cylinder.

11. A damping device as claimed in claim 9 further comprising said transfer roller being mounted on said holders by means of an antifriction bearing.

12. A damping device as claimed in claim 11 further comprising said adjusting means comprising a screw bearing against said antifriction bearing.

* * * * *